US011167944B2

(12) United States Patent
Morisawa et al.

(10) Patent No.: US 11,167,944 B2
(45) Date of Patent: Nov. 9, 2021

(54) RECORDING APPARATUS

(71) Applicant: SEIKO EPSON CORPORATION, Tokyo (JP)

(72) Inventors: Ryoichi Morisawa, Shiojiri (JP); Shingo Waki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 64 days.

(21) Appl. No.: 16/719,038

(22) Filed: Dec. 18, 2019

(65) Prior Publication Data

US 2020/0198907 A1 Jun. 25, 2020

(30) Foreign Application Priority Data

Dec. 21, 2018 (JP) ..... JP2018-239622

(51) Int. Cl.
*B65H 1/26* (2006.01)
*B65H 1/04* (2006.01)

(52) U.S. Cl.
CPC ..... *B65H 1/266* (2013.01); *B65H 1/04* (2013.01); *B65H 2405/11164* (2013.01); *B65H 2405/31* (2013.01); *B65H 2553/61* (2013.01)

(58) Field of Classification Search
CPC ..... B65H 1/266; B65H 2405/31; B65H 2405/32; B65H 2405/115; B65H 2405/1116; B65H 2405/11164; B65H 2405/1122; B65H 2553/61; B65H 2511/11; B65H 1/04; G03G 15/6502
See application file for complete search history.

(56) References Cited

U.S. PATENT DOCUMENTS 8,746,684 B2 * 6/2014 Okano ..... B65H 31/00 271/171
8,814,158 B2 * 8/2014 Washino ..... B65H 31/20 271/3.14
2017/0003635 A1 1/2017 Koga et al.

FOREIGN PATENT DOCUMENTS

JP H09194051 7/1997
JP 2017013973 1/2017

* cited by examiner

*Primary Examiner* — Luis A Gonzalez
(74) *Attorney, Agent, or Firm* — Workman Nydegger

(57) ABSTRACT

A medium accommodation cassette includes a first medium accommodation portion that forms a portion of a medium accommodation region and a second medium accommodation portion that forms a portion of the medium accommodation region and is configured to be switchable between a first state and a second state in which the second medium accommodation portion is displaced from a position thereof in the first state in a cassette removing direction so as to stretch the medium accommodation region. A step portion on a side surface, which is formed between the first medium accommodation portion and the second medium accommodation portion, is positioned inside an insertion/removal mouth when the second medium accommodation portion assumes the second state in the state in which the medium accommodation cassette is installed in the insertion/removal mouth.

4 Claims, 15 Drawing Sheets

RECORDING APPARATUS

The present application is based on, and claims priority from JP Application Serial Number 2018-239622, filed Dec. 21, 2018, the disclosure of which is hereby incorporated by reference herein in its entirety.

BACKGROUND

1. Technical Field

The present disclosure relates to a recording apparatus equipped with a medium accommodation cassette that accommodates media.

2. Related Art

In a recording apparatus of which a printer or a copier is a representative example, a sheet cassette that is insertable to and removable from the apparatus body has been used widely. As described in the JP-A-2017-13973, a type of a sheet cassette is configured to be stretchable so as to accommodate large-size sheets when stretched.

In general, the above sheet cassette is constituted by a first sheet accommodation portion that is positioned deeper in the apparatus when installed and a second sheet accommodation portion that is positioned further in front and is slidable relative to the first sheet accommodation portion. On the other hand, a sheet feeding mechanism is disposed in the deeper region in the apparatus where the first sheet accommodation portion is positioned. Accordingly, it is desirable to reduce the width of the sheet cassette. In contrast, the second sheet accommodation portion, which is positioned closer to the front, preferably has a width greater than that of the first sheet accommodation portion from a handling point of view since the second sheet accommodation portion is grasped by a user when the user inserts/removes the sheet cassette.

SUMMARY

However, when the sheet cassette is stretched for accommodating large-size sheets, the second sheet accommodation portion protrudes from a cassette insertion/removal mouth of the apparatus body, which results in widening of the gap between a side surface of the first sheet accommodation portion and an inner wall of the cassette insertion/removal mouth. In addition, this may cause the sheet cassette to orient obliquely with respect to the sheet transporting direction and accordingly a recording sheet to be transported obliquely. This leads to the likelihood of dust entering the apparatus readily through the gap.

According to an aspect of the present disclosure, a recording apparatus includes an apparatus body including a recording unit that performs recording onto a medium, and a medium accommodation cassette that is configured to be inserted into and removed from the apparatus body through an insertion/removal mouth formed in the apparatus body and that has a medium accommodation region formed therein for accommodating the medium. The medium accommodation cassette is configured such that the medium accommodation region is stretchable and contractible in a cassette insertion/removal direction. In the recording apparatus, the medium accommodation cassette includes a first medium accommodation portion that forms a portion of the medium accommodation region, and a second medium accommodation portion that forms a portion of the medium accommodation region and is located further, from the first medium accommodation portion, in a cassette removing direction in which the medium accommodation cassette is being removed from the apparatus body. The second medium accommodation portion is configured to be switchable between a first state and a second state in which the second medium accommodation portion is displaced from a position thereof in the first state in the cassette removing direction so as to stretch the medium accommodation region. In addition, in a width direction that orthogonally intersects the cassette insertion/removal direction, a maximum length of the second medium accommodation portion is made greater than a maximum length of the first medium accommodation portion, and a step portion is formed on a side surface of the medium accommodation cassette. Moreover, the step portion is positioned inside the insertion/removal mouth when the second medium accommodation portion assumes the second state in the state in which the medium accommodation cassette is inserted in the apparatus body.

DESCRIPTION OF EXEMPLARY EMBODIMENTS

Figure 1:
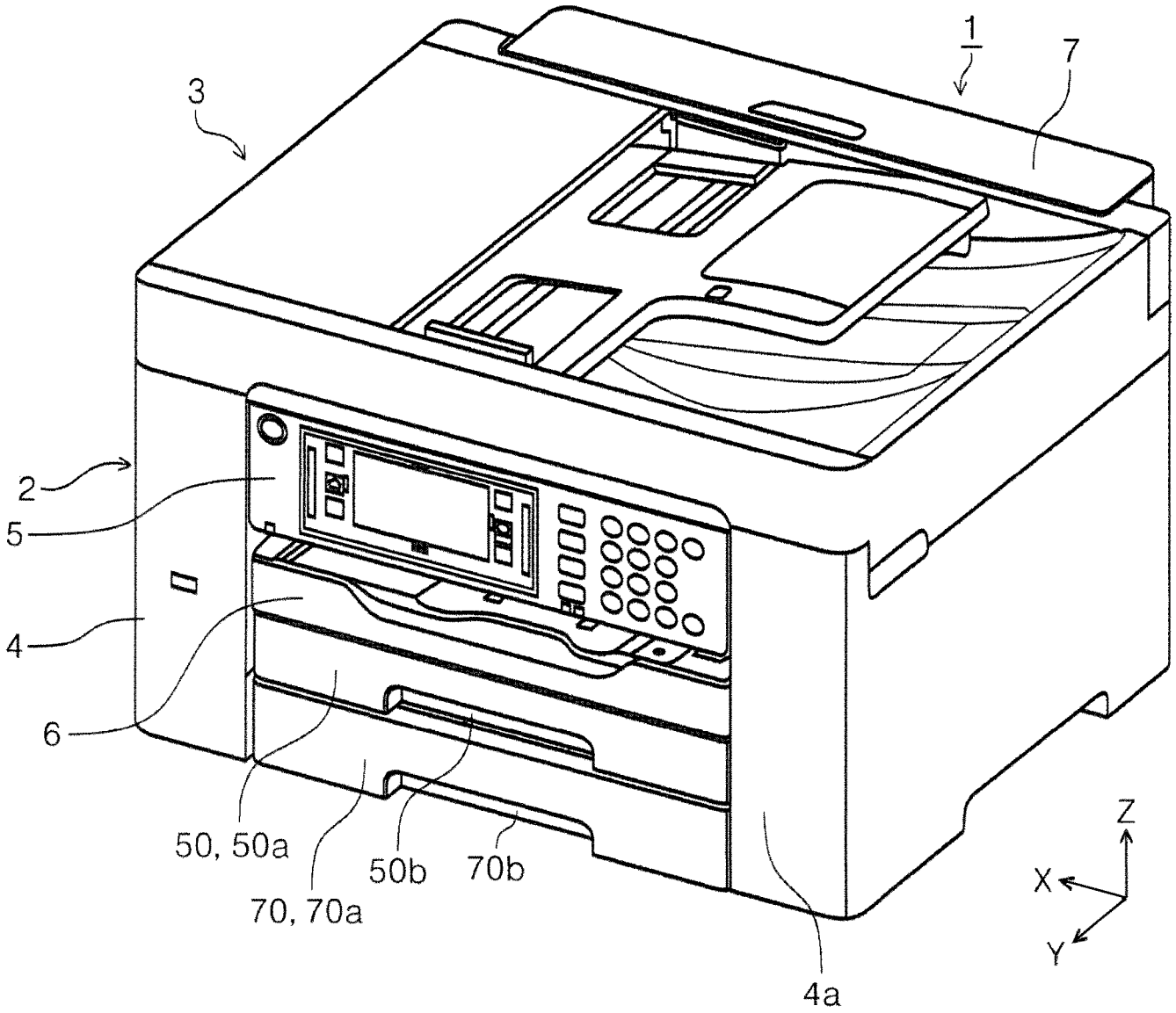
FIG. 1 is a perspective view illustrating a printer in which sheet cassettes are in a first state.

First, the present disclosure is outlined as follows. A recording apparatus includes an apparatus body including a recording unit that performs recording onto a medium and a medium accommodation cassette that is configured to be inserted into and removed from the apparatus body through an insertion/removal mouth formed in the apparatus body and that has a medium accommodation region formed therein for accommodating the medium. The medium accommodation cassette is configured such that the medium accommodation region is stretchable and contractible in a cassette insertion/removal direction. In the recording apparatus, the medium accommodation cassette includes a first medium accommodation portion that forms a portion of the medium accommodation region and a second medium accommodation portion that forms a portion of the medium accommodation region and is located further, from the first medium accommodation portion, in a cassette removing direction in which the medium accommodation cassette is being removed from the apparatus body. The second medium accommodation portion is configured to be switchable between a first state and a second state in which the second medium accommodation portion is displaced from a position thereof in the first state in the cassette removing direction so as to stretch the medium accommodation region. In addition, in a width direction that orthogonally intersects the cassette insertion/removal direction, a maximum length of the second medium accommodation portion is made greater than a maximum length of the first medium accommodation portion, and a step portion is formed on a side surface of the medium accommodation cassette. Moreover, the step portion is positioned inside the insertion/removal mouth when the second medium accommodation portion assumes the second state in the state in which the medium accommodation cassette is inserted in the apparatus body.

According to this configuration, the medium accommodation cassette is constituted by the first medium accommodation portion and the second medium accommodation portion and has the step portion formed on a side surface. In addition, when the medium accommodation cassette is inserted through the insertion/removal mouth and the second medium accommodation portion assumes the second state, the step portion is positioned inside the insertion/removal mouth. As a result, irrespective of the stretched state of the medium accommodation cassette, the gap between an inner wall (side wall) of the insertion/removal mouth and a side surface of the medium accommodation cassette can be maintained within an appropriate range. This suppresses the likelihood of the medium accommodation cassette orienting obliquely with respect to the medium transporting direction, thereby suppressing the likelihood of a medium being transported obliquely. This also suppresses the likelihood of dust entering the apparatus through the gap.

In the recording apparatus, a portion of side surface of the second medium accommodation portion that is located further in the cassette removing direction from the step portion may be formed as a flat and smooth surface. Accordingly, when the second medium accommodation portion that assumes the second state protrudes outward from the insertion/removal mouth, the side surface of the protruding portion is flat and smooth, which can improve aesthetic appearance of the apparatus and leads to the easiness of grasping the second medium accommodation portion.

In the recording apparatus, the apparatus body may include an posture-maintaining member that is disposed inside the insertion/removal mouth and that maintains posture of the medium accommodation cassette by regulating a rise of the first medium accommodation portion when the medium accommodation cassette is drawn.

According to this configuration, the apparatus body includes the posture-maintaining member that is disposed inside the insertion/removal mouth and that maintains posture of the medium accommodation cassette by regulating a rise of the first medium accommodation portion when the medium accommodation cassette is drawn. As a result, when the medium accommodation cassette is drawn, the posture of the medium accommodation cassette is maintained, which enables a user to supply media to the cassette easily.

In the recording apparatus, the posture-maintaining member may be formed of an abutting member that comes into contact with the first medium accommodation portion from above, and the second medium accommodation portion may include a slit that is formed in an upper side of the second medium accommodation portion and is configured to receive the abutting member.

According to this configuration, the posture-maintaining member is formed of the abutting member that comes into contact with the first medium accommodation portion from above, and the second medium accommodation portion includes the slit that is formed in the upper side of the second medium accommodation portion and is configured to receive the abutting member. This prevents the abutting member and the second medium accommodation portion from abutting against each other and provides a region that allows the second medium accommodation portion to be displaced.

In the recording apparatus, a portion of upper edge of the second medium accommodation portion that is located further in the cassette removing direction from the step portion may be formed non-stepwise. According to this configuration, the portion of upper edge of the second medium accommodation portion located further in the cassette removing direction from the step portion is formed non-stepwise. This can improve aesthetic appearance of the apparatus and leads to the easiness of grasping the second medium accommodation portion.

The recording apparatus may include a plurality of the medium accommodation cassettes, and the medium accommodation cassettes may be a first medium accommodation cassette and a second medium accommodation cassette that is positioned under the first medium accommodation cassette. In addition, in the apparatus body, a region for accommodating the first medium accommodation cassette may be formed so as not to be separated from a region for accommodating the second medium accommodation cassette. In addition, a height of front surface of the second medium accommodation cassette may be made greater than a height of front surface of the first medium accommodation cassette in such a manner that an upper edge of front surface of the second medium accommodation cassette is positioned close to a lower edge of front surface of the first medium accommodation cassette.

According to this configuration, the region for accommodating the first medium accommodation cassette is formed so as not to be separated from the region for accommodating the second medium accommodation cassette in the apparatus body, which enables sheet jamming to be handled easily. Moreover, the height of front surface of the second medium accommodation cassette is made greater than the height of front surface of the first medium accommodation cassette in such a manner that the upper edge of front surface of the second medium accommodation cassette is positioned close to the lower edge of front surface of the first medium accommodation cassette. As a result, the gap between the first medium accommodation cassette and the second medium accommodation cassette can be made small, which improves aesthetic appearance of the apparatus and also reduces the amount of dust entering the apparatus.

In the recording apparatus, the second medium accommodation portion of the first medium accommodation cassette may have a cover member that covers the medium accommodation region from above. In addition, when the second medium accommodation portion of the first medium accommodation cassette is switched to the second state, a portion of the medium accommodation region that protrudes outward from a front side of the apparatus may be covered with the cover member from above.

According to this configuration, the second medium accommodation portion of the first medium accommodation cassette has a cover member that covers the medium accommodation region from above. In addition, when the second medium accommodation portion of the first medium accommodation cassette is switched to the second state, the portion of the medium accommodation region that protrude outward from the front side of the apparatus is covered with the cover member from above. As a result, the inside of the second medium accommodation portion is prevented from being exposed, which improves aesthetic appearance of the apparatus and can reduce the amount of dust entering the apparatus.

Now, the present disclosure will be described specifically. Note that in the drawings, the apparatus width direction is parallel to the X-axis direction, in other words, the sheet width direction that intersects the sheet transporting direction. When a user faces the front side of the apparatus, the +X direction is the leftward direction with respect to the user, and the −X direction is the rightward direction. The apparatus depth direction is parallel to the Y-axis direction. The +Y direction is the direction from the rear side to the front side of the apparatus, and the −Y direction is the direction from the front side to the rear side of the apparatus. In addition, the insertion/removal directions of a first sheet cassette 50 and a second sheet cassette 70 (to be described later) are parallel to the Y-axis direction. The +Y direction is the direction of removing each sheet cassette, and the −Y direction is the direction of inserting the sheet cassette. The vertical direction is parallel to the Z-axis direction. The +Z direction is the vertically upward direction and the −Z direction is the vertically downward direction. In embodiments described herein, among sides surrounding the apparatus, the front side of the apparatus is a side on which an operation unit 5 is disposed.

Figure 2:
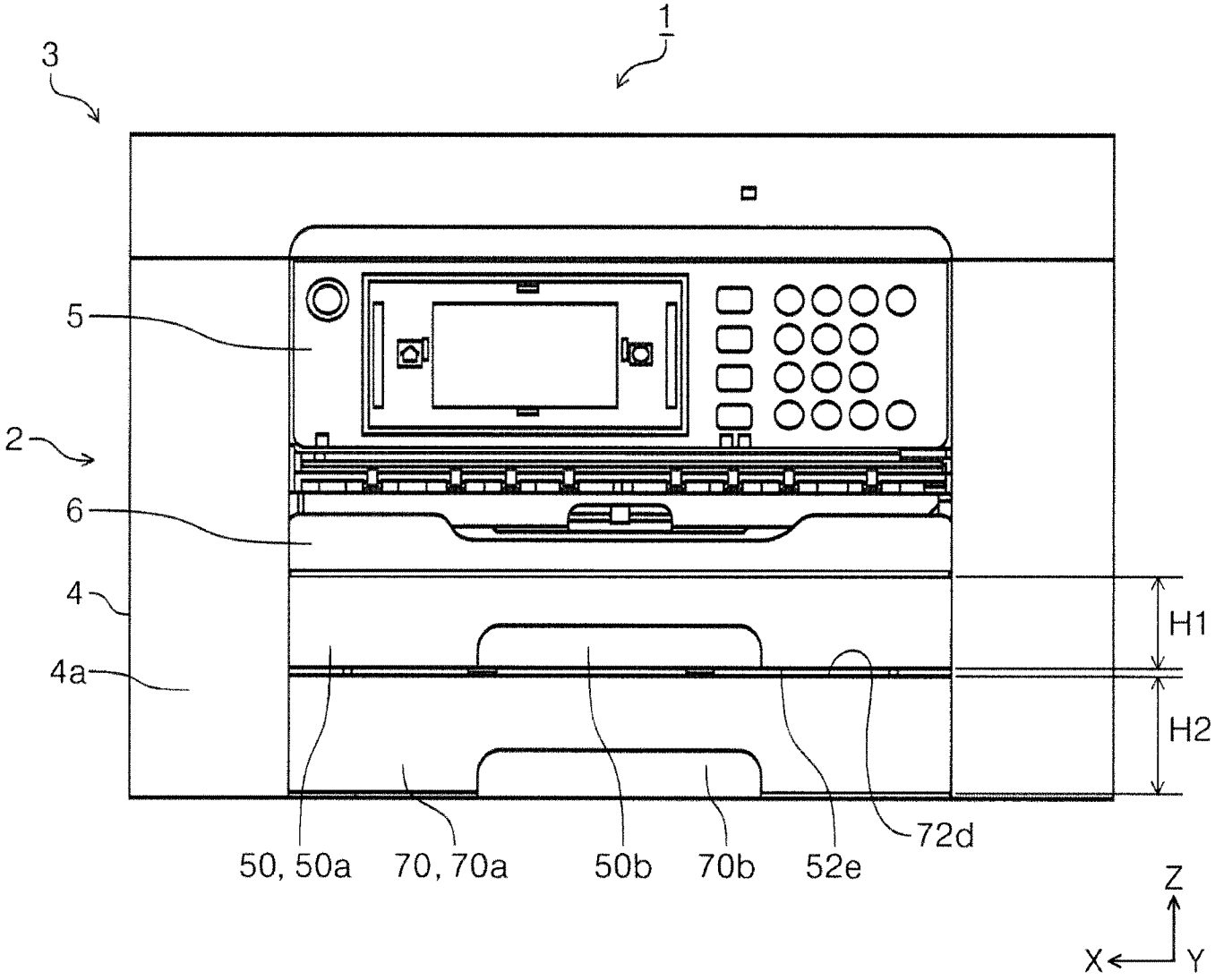
FIG. 2 is a front view illustrating the printer in which the sheet cassettes are in the first state.
Figure 3:
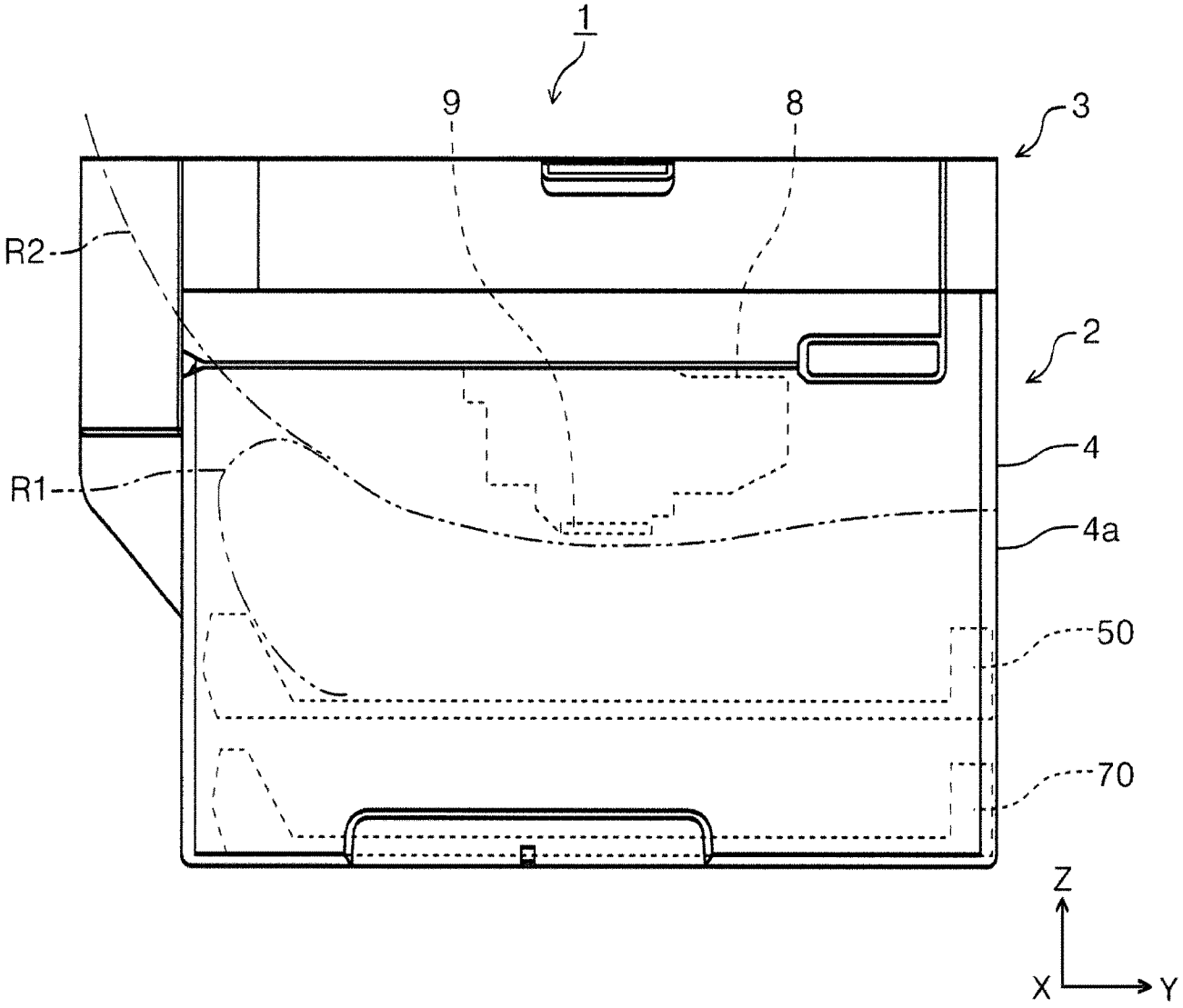
FIG. 3 is a side view illustrating the printer in which the sheet cassettes are in the first state.

As illustrated in FIGS. 1 to 3, an ink jet printer 1 (hereinafter referred to as a "printer") includes an apparatus body 2 and a scanner unit 3 disposed on the apparatus body 2. The printer 1 is an example of the recording apparatus. The entire shell of the apparatus body 2 is shaped like a box, and the shell is formed in such a manner that the apparatus body 2 and the scanner unit 3 are flush with each other on the front, right, and left sides. Note that the right side surface and left side surface of the apparatus body 2 and the scanner unit 3 are formed as vertical surfaces that are flat and smooth.

The apparatus body 2 has a function of recoding on a recording sheet, which is an example of a medium, and the scanner unit 3 has a function of reading a document. Note that the scanner unit 3 includes an auto document feeder (ADF) that feeds each document automatically from documents set thereon. The apparatus body 2 includes a recording head 9 (FIG. 3), which is an example of a recording unit, and transport paths R1 and R2 (FIG. 3) through which recording sheets are transported. In the present embodiment, the apparatus body 2 also includes a first sheet cassette 50 and a second sheet cassette 70, which are examples of a medium accommodation cassette. The first sheet cassette 50 and the second sheet cassette 70 are removable from and insertable into the apparatus body 2. Note that in the present specification, the first sheet cassette 50 and the second sheet cassette 70 may be abbreviated to the "sheet cassettes".

The apparatus body 2 is configured to enable sheets to be set on the rear side of the apparatus and fed therefrom as well as from the first sheet cassette 50 and the second sheet cassette 70. Reference 7 denotes a cover that opens/closes sheet-setting opening (not illustrated) to be used for setting sheets on the rear side of the apparatus.

The apparatus body 2 includes the operation unit 5 to be used for operating the printer 1 on the front side of the apparatus. The operation unit 5 includes a display and multiple operation buttons and is formed to be tiltable. A tray 6 is disposed under the operation unit 5. The tray 6 receives recording sheets discharged after recording is performed. The tray 6 is disposed so as to be able to assume a state in which the tray 6 is accommodated inside the apparatus body 2 as illustrated in FIG. 1 or a state in which the tray 6 is pulled out of the apparatus body 2 (not illustrated).

The outer shell of the apparatus body 2 is a housing 4. The front surface 4*a* of the housing 4 is a vertical surface that are flat and smooth. The front surfaces of the scanner unit 3, the tray 6, the first sheet cassette 50, and the second sheet cassette 70 are formed as vertical surfaces that are flat and smooth. The operation-side surface of the operation unit 5 also forms a vertical surface when it is closed. The first sheet cassette 50 and the second sheet cassette 70 are configured to be stretchable, which will be described in detail later, and FIGS. 1 to 3 illustrate the state in which the cassettes are least stretched. As illustrated in FIGS. 1 and 3, the operation-side surface of the operation unit 5 and the front surfaces of the scanner unit 3, the tray 6, the first sheet cassette 50, and the second sheet cassette 70 are substantially flush with each other on the front side of the apparatus when the cassettes are least stretched, the tray 6 is accommodated, and the operation unit 5 is closed. Note that a hand recess 50*b* is formed on the front side of the first sheet cassette 50, and a hand recess 70*b* is formed on the front side of the second sheet cassette 70.

Next, the first sheet cassette 50 and the second sheet cassette 70 will be described further below. Note that although a configuration of the first sheet cassette 50 is mainly described with reference to FIGS. 9 and 10, the configuration of the second sheet cassette 70 is basically the same as that of the first sheet cassette 50. The differences between the first sheet cassette 50 and the second sheet cassette 70 are that the second sheet cassette 70 does not include a cover member 56 and the height of a second sheet accommodation portion 52 that constitutes the first sheet cassette 50 is smaller than the height of a second sheet accommodation portion 72 that constitutes the second sheet cassette 70. These points will be described later.

Figure 9:
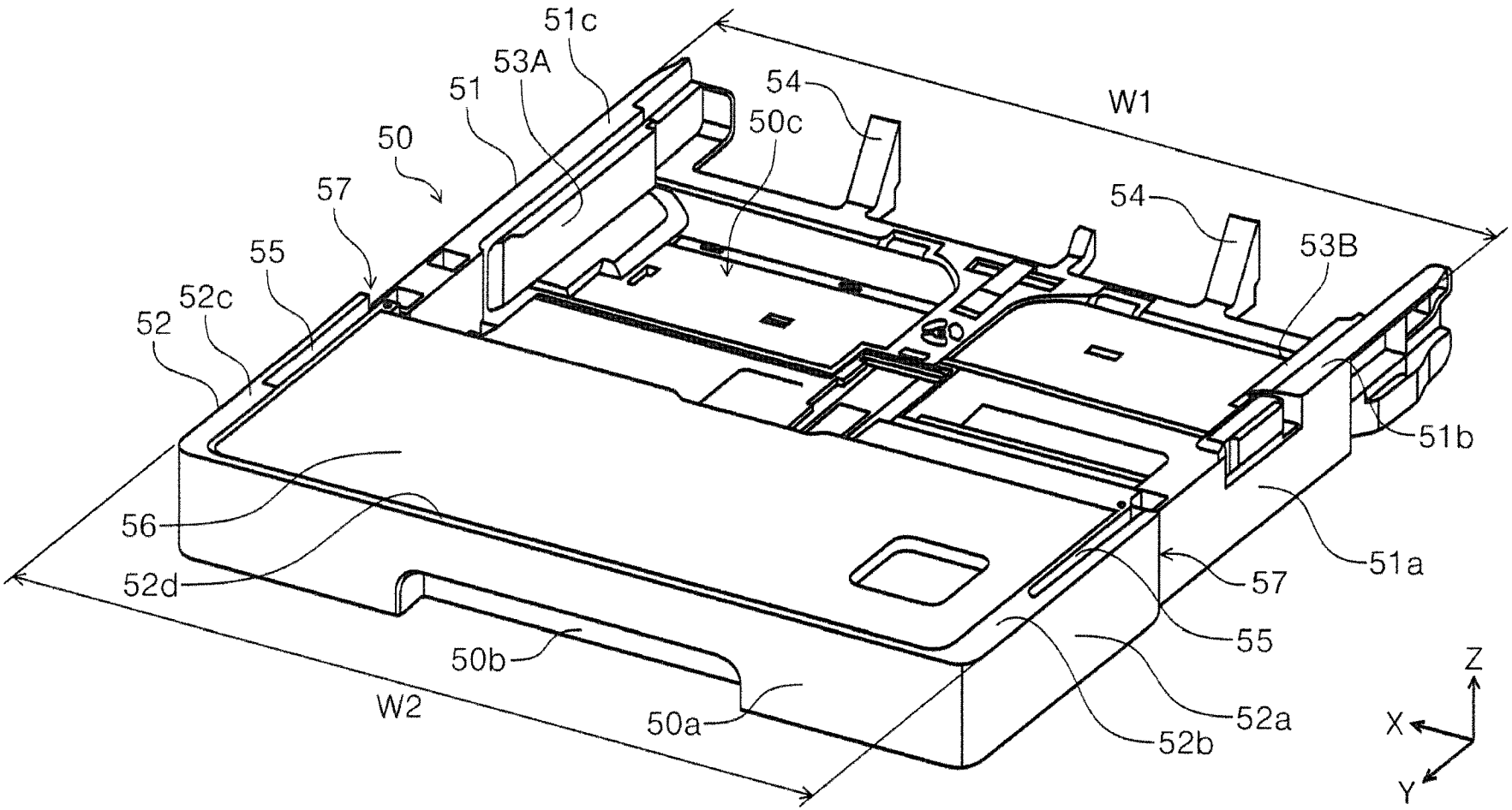
FIG. 9 is a perspective view illustrating a first sheet cassette that is in the first state.
Figure 10:
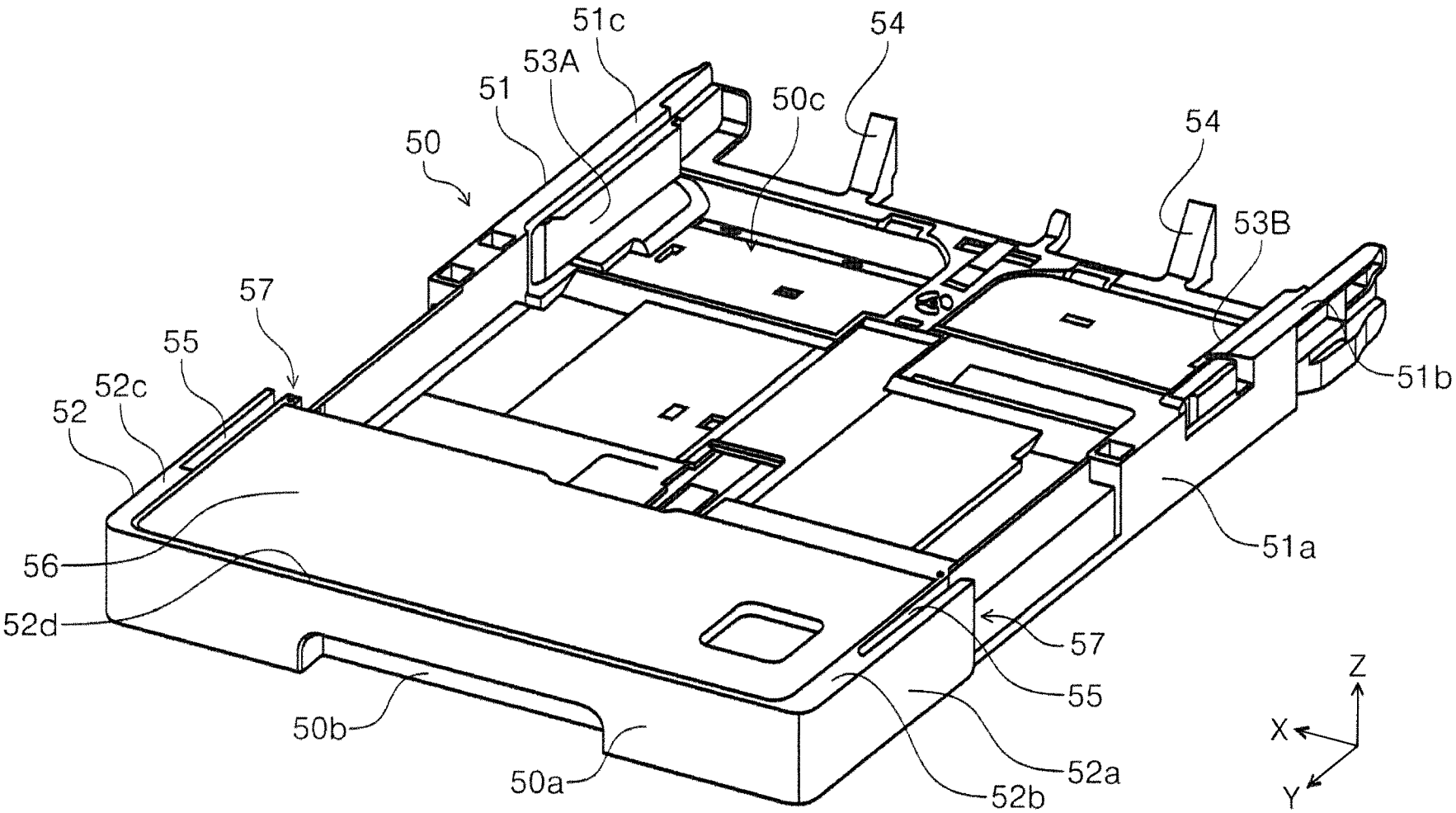
FIG. 10 is a perspective view illustrating the first sheet cassette that is in the second state.

As illustrated in FIGS. 9 and 10, the first sheet cassette 50 includes a sheet accommodation region 50*c* that is a region in which recording sheets are accommodated. The sheet accommodation region 50*c* is formed by a first sheet accommodation portion 51 and a second sheet accommodation portion 52 that is located further in the +Y direction from the first sheet accommodation portion 51. In the state in which the first sheet cassette 50 is installed in the apparatus body 2 or in the state in which the first sheet cassette 50 is removed from the apparatus body 2, the sheet accommodation region 50*c* expands by sliding the second sheet accommodation portion 52 in the +Y direction against the first sheet accommodation portion 51, and the sheet accommodation region 50*c* contracts by sliding the second sheet accommodation portion 52 in the −Y direction. The state of the second sheet accommodation portion 52 when the sheet accommodation region 50*c* contracts most is hereinafter referred to as a "first state", whereas the state of the second sheet accommodation portion 52 when the sheet accommodation region 50*c* expands most is referred to as a "second state". Note that the X-Y-Z coordinate system indicated in FIGS. 9 and 10 is the coordinate system applied when the first sheet cassette 50 is installed in the apparatus body 2.

Figure 4:
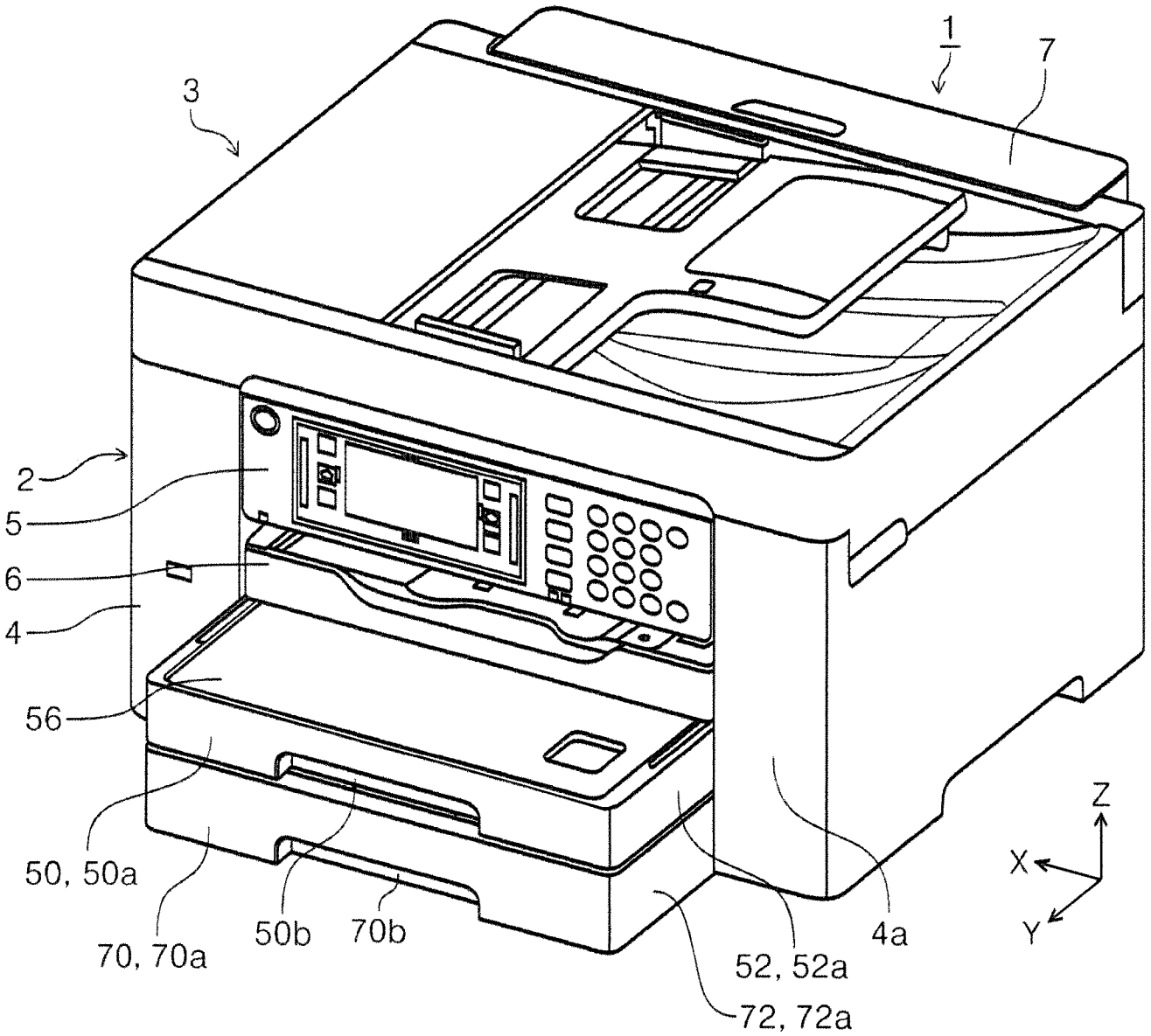
FIG. 4 is a perspective view illustrating the printer in which the sheet cassettes are in a second state.
Figure 5:
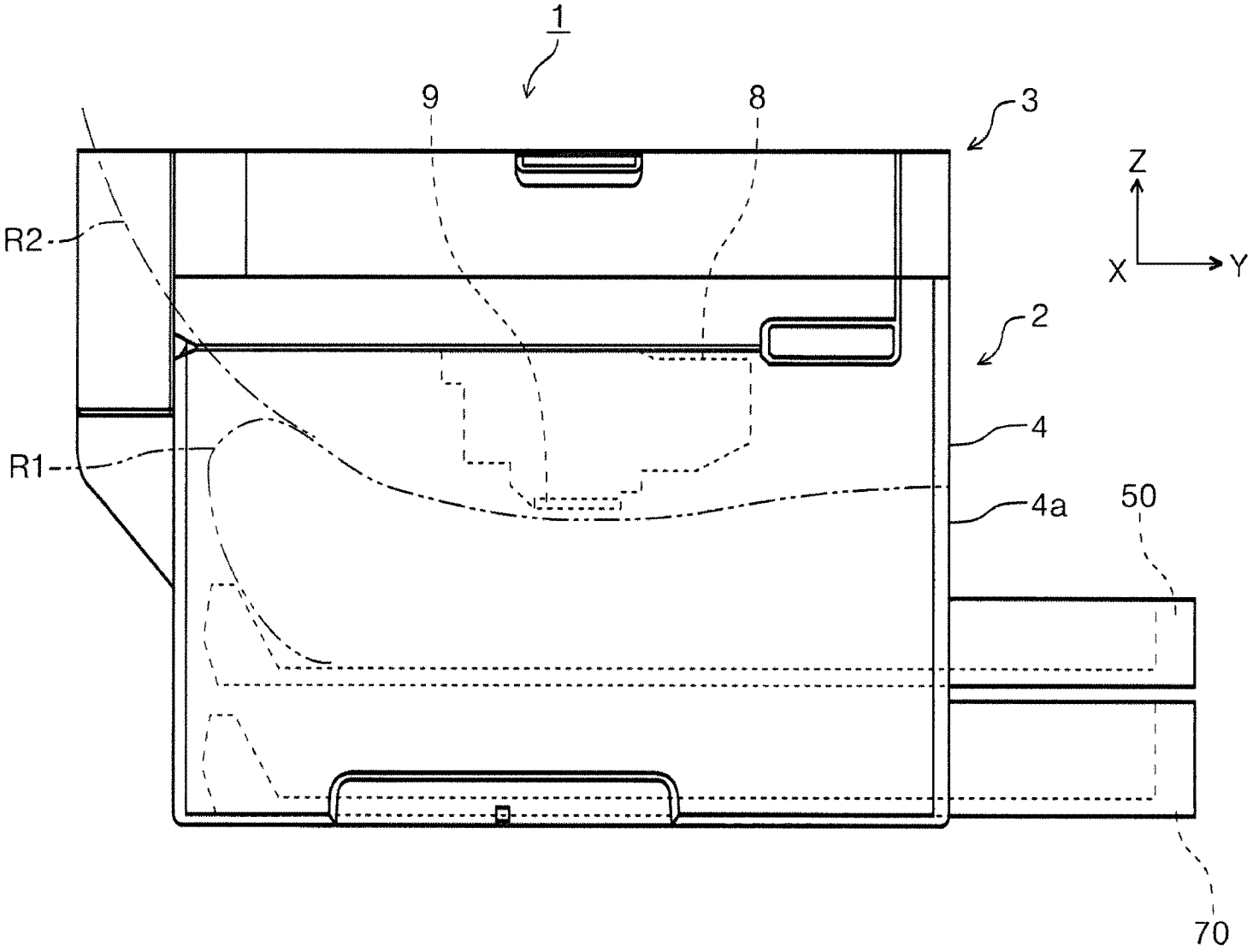
FIG. 5 is a side view illustrating the printer in which the sheet cassettes are in the second state.
Figure 6:
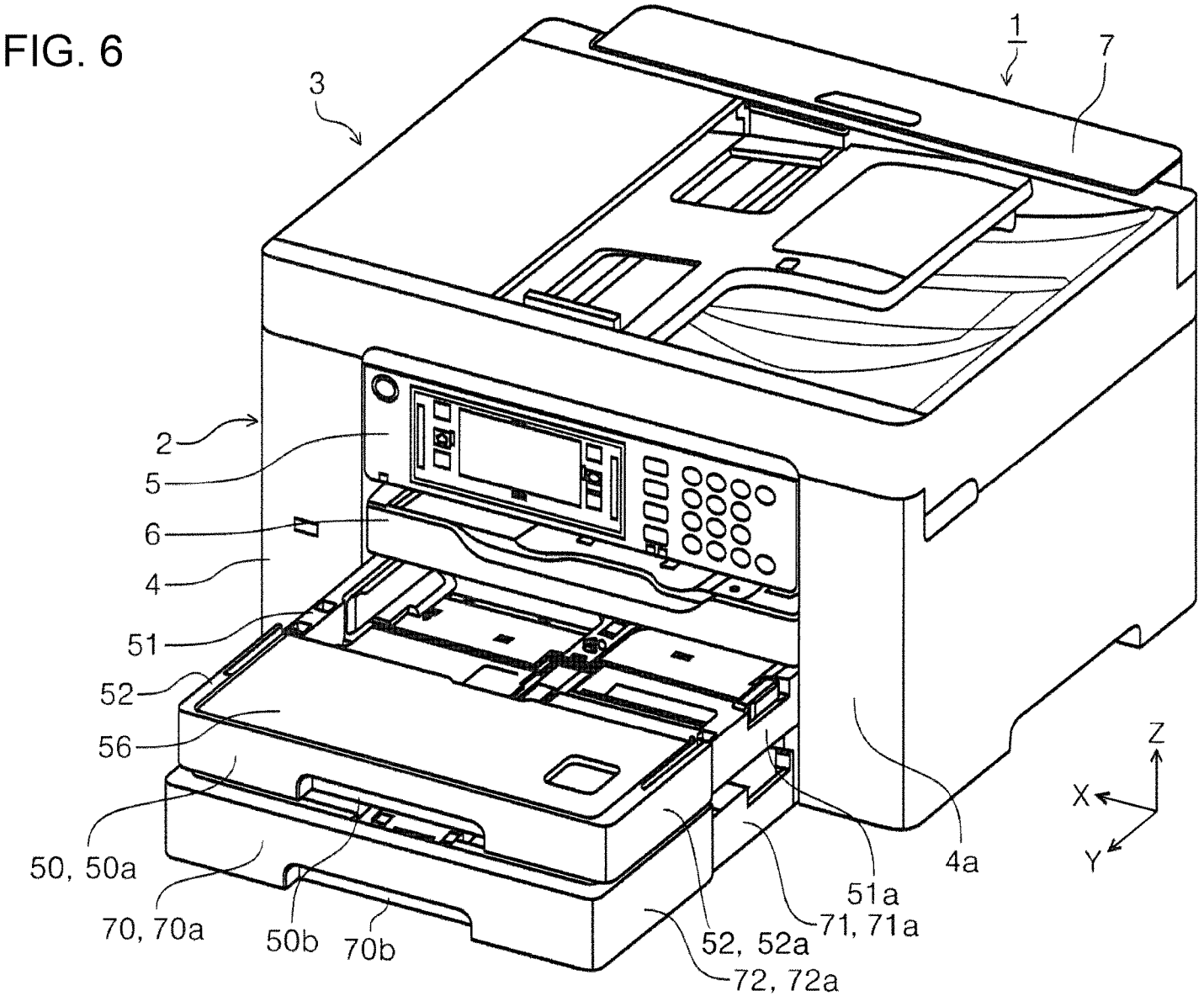
FIG. 6 is a perspective view illustrating a printer in which the sheet cassettes are drawn halfway.

FIGS. 1 to 3 illustrate the state in which the second sheet accommodation portion 52 of the first sheet cassette 50 and the second sheet accommodation portion 72 of the second sheet cassette 70 are in the first state. FIGS. 4 and 5 illustrate the state in which the second sheet accommodation portion 52 of the first sheet cassette 50 and the second sheet accommodation portion 72 of the second sheet cassette 70 are in the second state.

As illustrated in FIGS. 9 and 10, the first sheet accommodation portion 51 includes sheet-edge guides 53A and 53B disposed therein so as to be slidable in the +X and −X directions. In addition, the first sheet accommodation portion 51 includes stoppers 54 that regulate the end positions of accommodated recording sheets in the −Y direction, which is the direction of feeding the recording sheets.

In FIG. 9, a dimension W1 is a maximum width of the first sheet accommodation portion 51 in the width direction (X direction). The maximum width W1 is defined by both side surfaces 51*a* of the first sheet accommodation portion 51. Note that the side surface 51*a* on the left is not visible in FIG. 9. In addition, in FIG. 9, a dimension W2 is a maximum width of the second sheet accommodation portion 52, and the maximum width W2 is defined by both side surfaces 52*a* of the second sheet accommodation portion 52. Note that the side surface 52*a* on the left is not visible in FIG. 9. In the present embodiment, the maximum width W2 of the second sheet accommodation portion 52 is greater than the maximum width W1 of the first sheet accommodation portion 51. As a result, a step portion 57 is formed on the border between the first sheet accommodation portion 51 and the second sheet accommodation portion 52 on both side surfaces of the first sheet cassette 50.

When the first sheet cassette 50 is installed in the apparatus body 2, the width of the first sheet cassette 50 is desired to be small because a feeding mechanism is disposed in a deep region in the apparatus where the first sheet accommodation portion 51 is located. On the other hand, the second sheet accommodation portion 52, which is positioned closer to the front, preferably has a greater width than the first sheet accommodation portion 51 from a handling point of view since this portion is grasped by a user when the user inserts/removes the first sheet cassette 50. Accordingly, the maximum width W2 of the second sheet accommodation portion 52 is set wider than the maximum width W1 of the first sheet accommodation portion 51. Note that the height of the second sheet accommodation portion 52 is greater than that of the first sheet accommodation portion 51. As a result, steps are formed also on respective upper edges of side walls of the first sheet cassette 50. In the Y direction, the positions of respective steps on the upper edges of the both side walls are the same as the positions of respective steps on the side surfaces (i.e., the step portions 57) of the both side walls. The same applies to the second sheet cassette 70.

Figure 7:
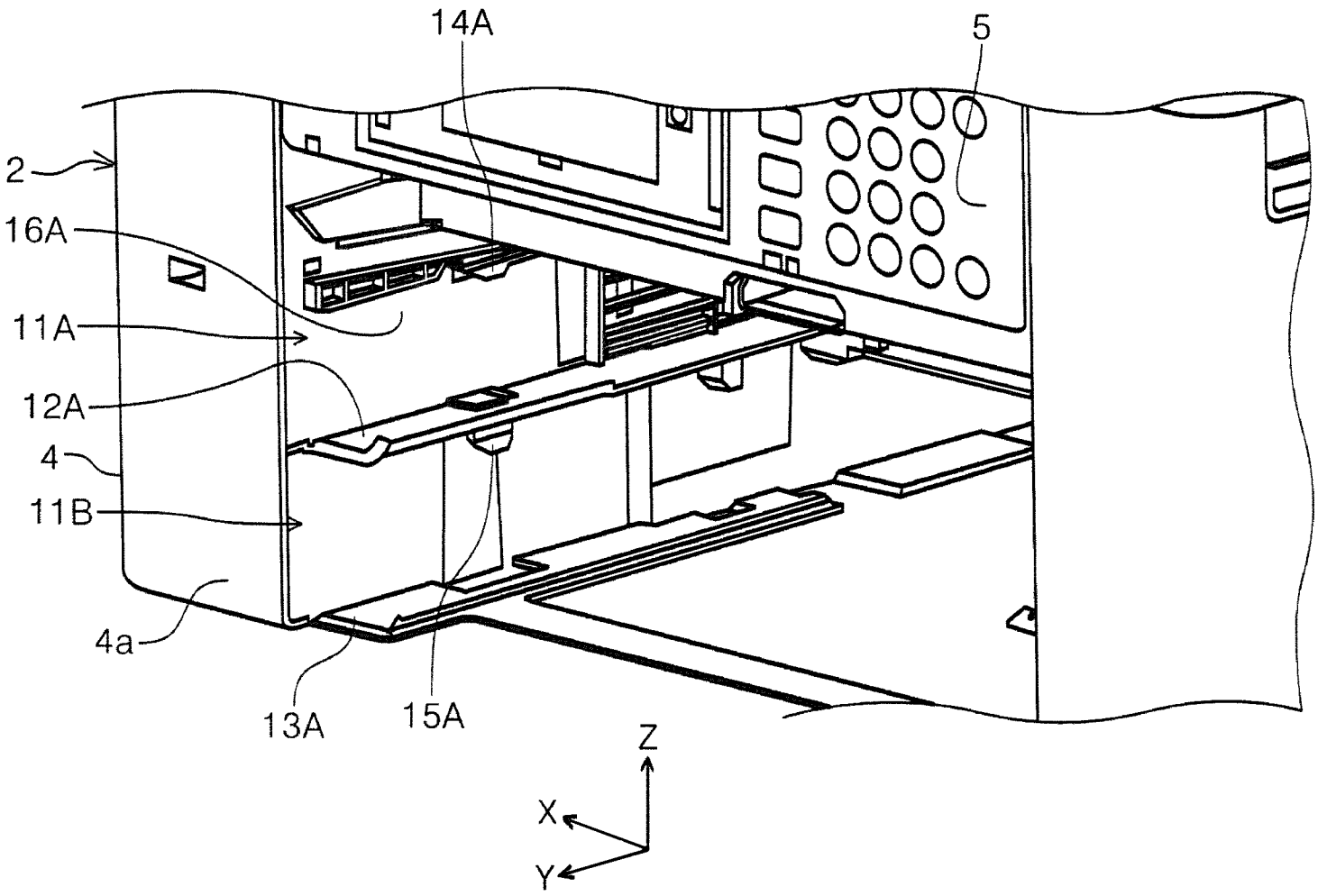
FIG. 7 is a perspective view illustrating a left inner wall in cassette insertion/removal mouths.
Figure 8:
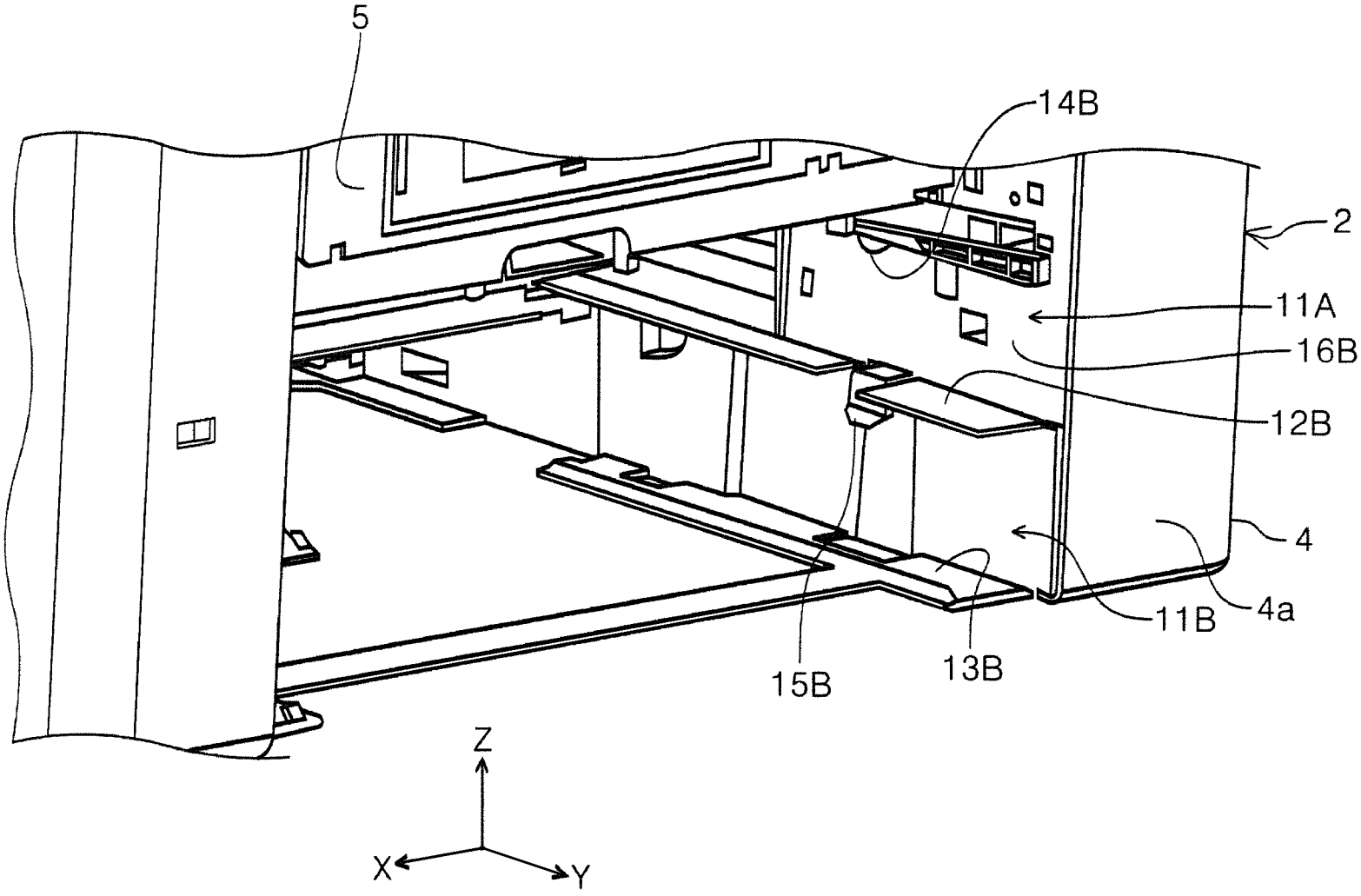
FIG. 8 is a perspective view illustrating a right inner wall in the cassette insertion/removal mouths.

Next, a configuration of an insertion/removal portion (an insertion/removal mouth) used for inserting and removing the sheet cassettes will be described with reference to FIGS. 7, 8, 11, and 12. In FIGS. 7 and 8, reference 11A denotes a first insertion/removal mouth for inserting/removing the first sheet cassette 50, and reference 11B denotes a second insertion/removal mouth for inserting/removing the second sheet cassette 70. A partition wall is not provided, in other words, there is no separation, between the first insertion/removal mouth 11A and the second insertion/removal mouth 11B, which are integrally formed into one large opening portion.

As illustrated in FIG. 7, an upper left guide 12A and a lower left guide 13A are formed on a left inner wall 16A inside the opening portion, and as illustrated in FIG. 8, an upper right guide 12B and a lower right guide 13B are formed on a right inner wall 16B inside the opening portion. These guides extend in the Y direction. The upper left guide 12A and the upper right guide 12B guide the first sheet cassette 50 in the insertion/removal direction, and the lower left guide 13A and the lower right guide 13B guide the second sheet cassette 70 in the insertion/removal direction.

As illustrated in FIG. 7, an upper left projection 14A is formed above the upper left guide 12A, and as illustrated in FIG. 8, an upper right projection 14B is formed above the upper right guide 12B. Similarly, as illustrated in FIG. 7, a lower left projection 15A is formed above the lower left guide 13A, and as illustrated in FIG. 8, a lower right projection 15B is formed above the lower right guide 13B. These projections are formed so as to project vertically downward.

The projections function as posture-maintaining members for maintaining the posture of each sheet cassette by preventing the first sheet accommodation portion from rising when the sheet cassette is drawn. More specifically, when the first sheet cassette 50 is drawn, the upper left projection 14A (FIG. 7) comes into contact with a left wall's upper edge 51*c* (FIG. 9) of the first sheet accommodation portion 51 from above, and at the same time, the upper right projection 14B (FIG. 8) comes into contact with a right wall's upper edge 51*b* (FIG. 9) of the first sheet accommodation portion 51 from above. As a result, when the first sheet cassette 50 is drawn, the posture of the first sheet cassette 50 is maintained. In other words, the projections are abutting members that come into contact with the first sheet cassette 50 from above. The same applies to the relation between the second sheet cassette 70 and the lower left projection 15A (FIG. 7) and the lower right projection 15B (FIG. 8).

Figure 12:
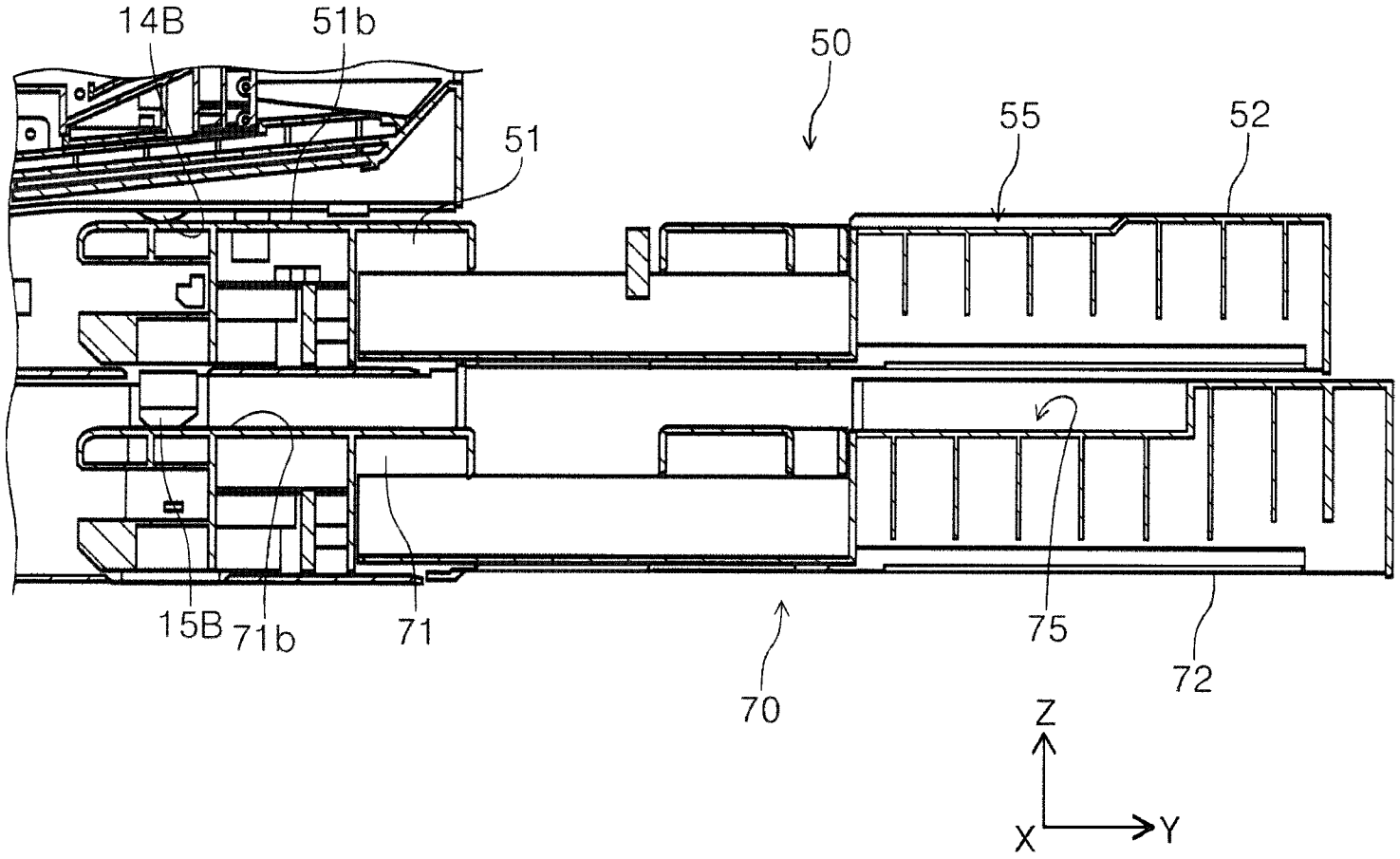
FIG. 12 is a cross-sectional side view illustrating the sheet cassettes that are cut along the slits thereof, in which the cassettes are in the second state.

FIG. 12 illustrates a state in which the posture of each sheet cassette is maintained by the projections. Note that the expression "the posture is maintained" does not mean that the posture of each cassette when the cassette is completely installed, in other words, the horizontal posture of each cassette, is strictly maintained even in the state in which the cassette is drawn as illustrated in FIG. 12. It means that the posture of the cassette is maintained in such a manner that the cassette may decline slightly but does not fall down. When each sheet cassette is drawn, the posture of the sheet cassette is maintained and the sheet cassette does not decline largely, which enables a user, for example, to supply recording sheets to the sheet cassette easily.

Figure 11:
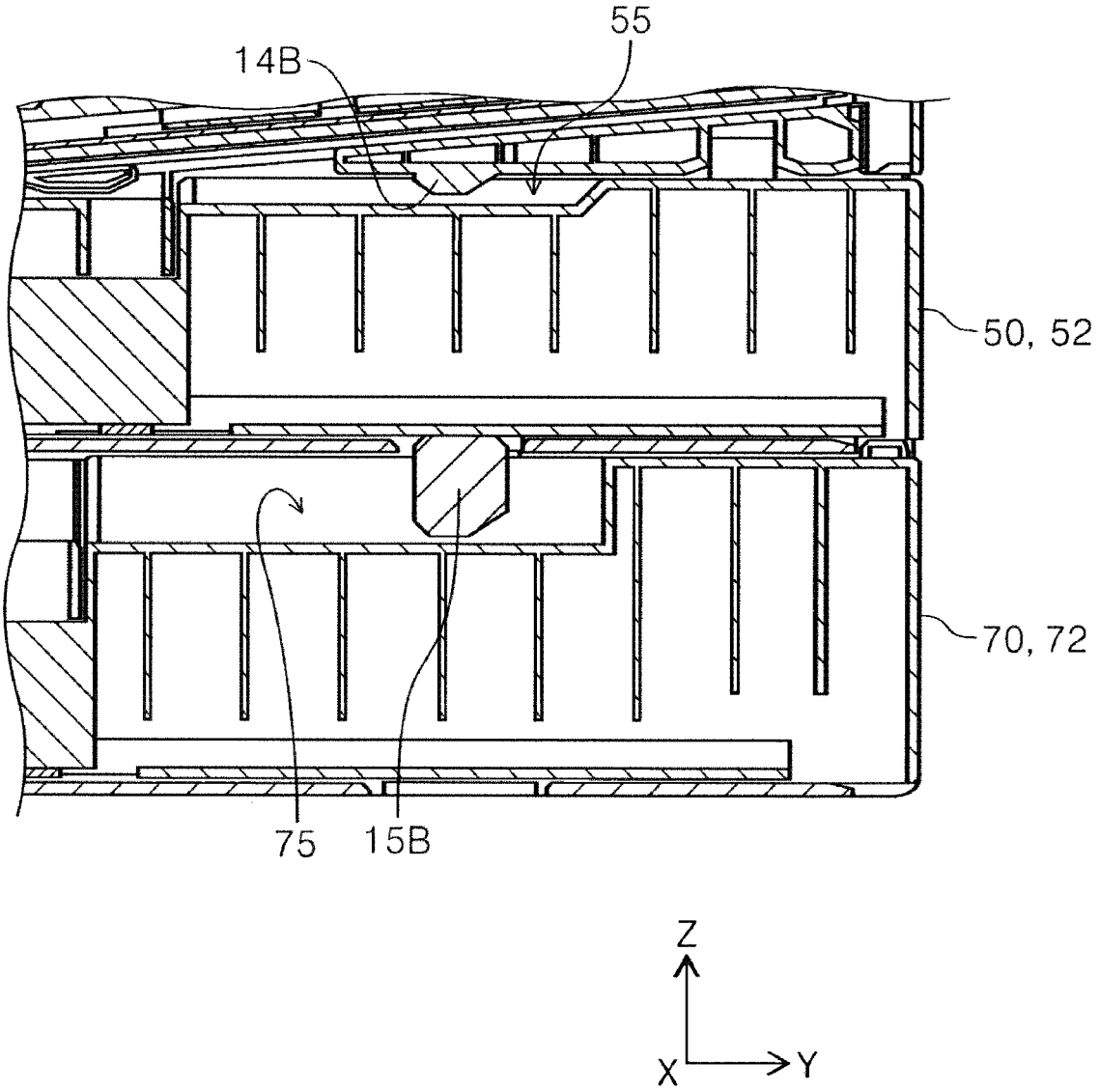
FIG. 11 is a cross-sectional side view illustrating the sheet cassettes that are cut along slits thereof, in which the cassettes are in the first state.

Here, when the second sheet accommodation portion 52 is switched from the second state to the first state while, for example, the first sheet cassette 50 is installed in the apparatus body 2, or when the first sheet cassette 50 removed from the apparatus body 2, which is in the first state, is reinserted into the apparatus body 2, the upper left projection 14A (FIG. 7) is positioned so as to interfere with a left wall's upper edge 52*c* (FIG. 9) of the second sheet accommodation portion 52. Similarly, the upper right projection 14B (FIG. 8) is positioned so as to interfere with a right wall's upper edge 52*b* (FIG. 9) of the second sheet accommodation portion 52. In the present embodiment, slits 55 that extend in the insertion/removal direction are formed in the upper surface of the second sheet accommodation portion 52, in other words, slits 55 are formed in the left wall's upper edge 52*c* and in the right wall's upper edge 52*b*, respectively. The slits 55 are configured to receive corresponding projections (FIG. 11). This prevents each projection and the second sheet accommodation portion 52 from abutting against each other and provides a region that allows the second sheet accommodation portion 52 to be displaced. Similarly, slits (denoted by reference 75 in FIG. 12) are also formed in respective sides of the second sheet cassette 70.

When the first sheet cassette 50 is installed in the first insertion/removal mouth 11A while the first sheet cassette 50 is in the most stretched state, in other words, while the second sheet accommodation portion 52 is in the second state, the step portions 57 on respective side surfaces illustrated in FIG. 10 are not exposed and are positioned inside the first insertion/removal mouth 11A, as illustrated in FIGS. 4 and 5. The same applies to the second sheet cassette 70. Irrespective of the stretching state of each sheet cassette, the gap between the left side surface of the sheet cassette and the left inner wall 16A (FIG. 7) and the gap between the right side surface of the sheet cassette and the right inner wall 16B (FIG. 8) can be maintained within an appropriate range. In other words, even if each sheet cassette is stretched most while installed in the apparatus body 2, the side surfaces of the second sheet accommodation portion of each sheet cassette are maintained so as to oppose corresponding inner walls of the insertion/removal mouth. This suppresses the likelihood of each sheet cassette orienting obliquely with respect to the sheet transporting direction (Y direction), thereby suppressing the likelihood of a recording sheet being transported obliquely. This also suppresses the likelihood of dust entering the apparatus through the gaps.

In the present embodiment, as illustrated in FIGS. 4 and 5, the side surface 52*a*, which is a surface portion located further in the +Y direction from each hidden step portion (i.e., the step portion 57 in FIG. 10), is formed as a flat and smooth surface. Accordingly, when the second sheet accommodation portion 52 protrude outward from the first insertion/removal mouth 11A, each side surface of the protruding portion is a flat and smooth surface, which can improve aesthetic appearance of the apparatus and leads to the easiness of grasping the second sheet accommodation portion 52. Note that the expression "flat and smooth surface" used herein means that the surface is smooth without having irregularities, but still the surface may have slight irregularities that are functionally required, such as screw holes and those required for the displaying purpose.

Similarly, a front wall's upper edge 52*d*, the right wall's upper edge 52*b*, and the left wall's upper edge 52*c* are upper edges located further in the +Y direction from each hidden step portion (i.e., the step portion 57 in FIG. 10) in the second sheet accommodation portion 52, and these edges are formed non-stepwise so as to have the same height. This can improve aesthetic appearance of the apparatus and leads to the easiness of grasping the second sheet accommodation portion 52. Note that the expression "these edges are formed non-stepwise" means that the front wall's upper edge 52*d*, the right wall's upper edge 52*b*, and the left wall's upper edge 52*c* are formed so as to have an equivalent height, in which the term "equivalent height" is meant to include slight height differences as well as the same height. In addition, in the first sheet cassette 50, the right side surface 52*a* continues to the front surface 50*a* and the left side surface (not illustrated) continues to the front surface 50*a*. This can improve aesthetic appearance of the apparatus. The same applies to the second sheet cassette 70.

In the present embodiment, the apparatus body 2 includes multiple sheet cassettes, in other words, the first sheet cassette 50 and the second sheet cassette 70 that is disposed under the first sheet cassette 50, both of which serve as the medium accommodation cassettes. As illustrated in FIGS. 7 and 8, the first insertion/removal mouth 11A for accommodating the first sheet cassette 50 and the second insertion/removal mouth 11B for accommodating the second sheet cassette 70 are formed so as not to be separated from each other in the apparatus body 2. Moreover, as illustrated in FIG. 2, the height H2 of front surface 70*a* of the second sheet cassette 70 is made greater than the height H1 of front surface 50*a* of the first sheet cassette 50 in such a manner that a front wall's upper edge 72*d* of the second sheet cassette 70 is positioned close to a front wall's lower edge 52*e* of the first sheet cassette 50.

As described above, the first insertion/removal mouth 11A for accommodating the first sheet cassette 50 and the second insertion/removal mouth 11B for accommodating the second sheet cassette 70 are formed so as not to be separated from each other. As a result, sheet jamming can be handled more easily. Eliminating a partition wall between the first insertion/removal mouth 11A and the second insertion/removal mouth 11B reduces the number of partitioning lines in appearance on the front side of the apparatus, which improves aesthetic appearance of the apparatus. As described above, the height H2 of front surface 70*a* of the second sheet cassette 70 is made greater than the height H1 of front surface 50*a* of the first sheet cassette 50 in such a manner that the front wall's upper edge 72*d* of the second sheet cassette 70 is positioned close to the front wall's lower edge 52*e* of the first sheet cassette 50. As a result, the vertical spacing between the first sheet cassette 50 and the second sheet cassette 70 can be made small, which improves aesthetic appearance of the apparatus and reduces the amount of dust entering the apparatus.

As a result of the seat cassettes being configured as above, the height of the second sheet accommodation portion 72 that constitutes the second sheet cassette 70 is greater than the height of second sheet accommodation portion 52 that constitutes the first sheet cassette 50 as illustrated in FIG. 12. On the other hand, the height of the first sheet accommodation portion 71 of the second sheet cassette 70 is the same as the height of first sheet accommodation portion 51 of the first sheet cassette 50. Accordingly, the lower left projection 15A and lower right projection 15B are formed so as to have a greater amount of downward projection than that of the upper left projection 14A and the upper right projection 14B. Accordingly, the slits 75 of the second sheet cassette 70 are formed deeper than the slits 55 of the first sheet cassette 50. In FIG. 12, reference 71*b* denotes a right wall's upper edge of the first sheet accommodation portion 71 that constitutes the second sheet cassette 70.

In addition, in the present embodiment, the second sheet accommodation portion 52 that constitutes the first sheet cassette 50 is provided with a cover member 56 that covers the sheet accommodation region 50*c* from above as illustrated in FIGS. 9, 10, and 4. When the second sheet accommodation portion 52 of the first sheet cassette 50 is switched to the second state, a portion of the sheet accommodation region 50*c* that protrudes frontward from the front side 4*a* of the apparatus is covered at the top with the cover member 56. This prevents the sheet accommodation region 50*c* of the first sheet cassette 50 from being exposed, which improves aesthetic appearance of the apparatus and reduces the amount of dust entering the apparatus.

Figure 13:
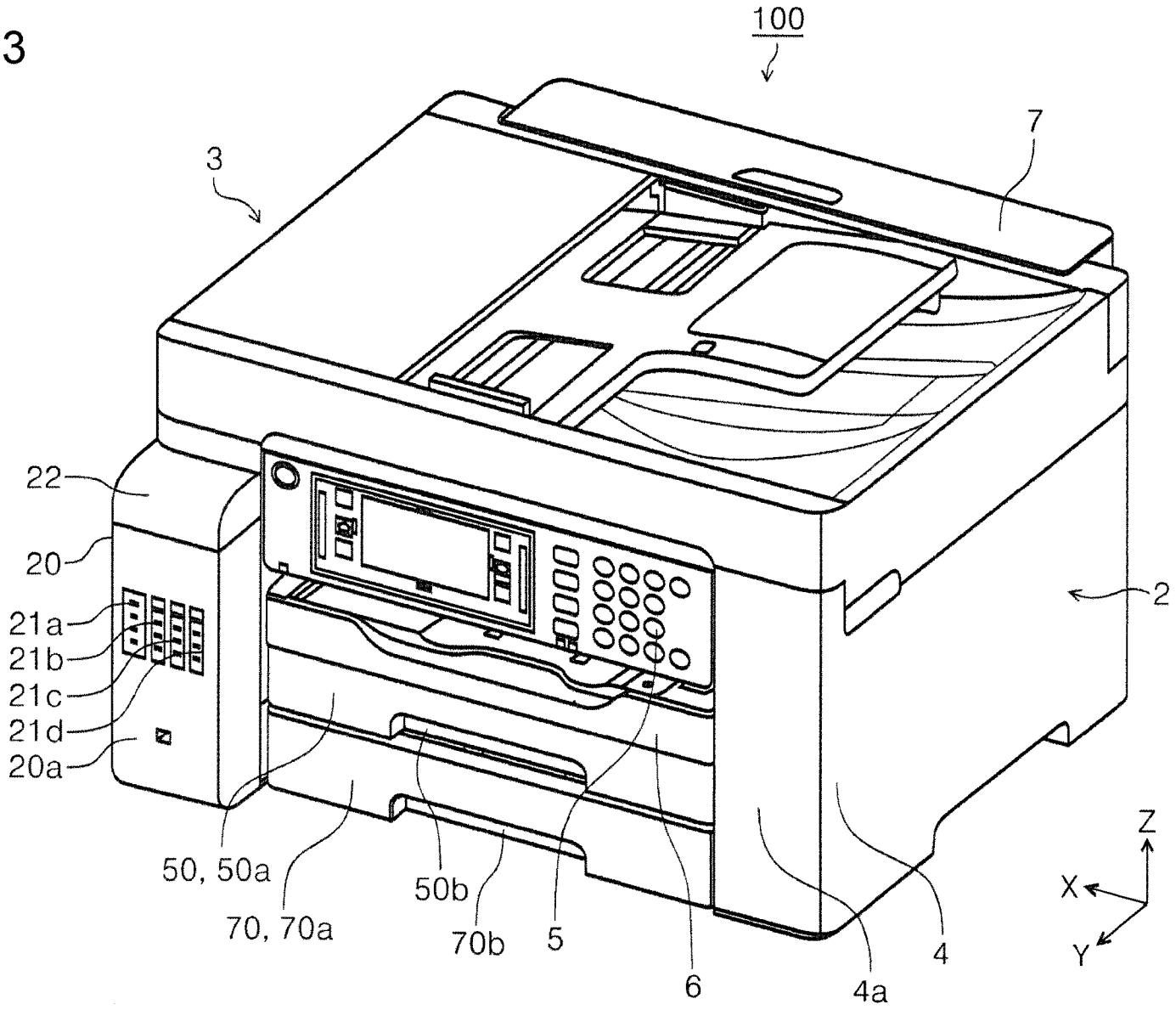
FIG. 13 is a perspective view illustrating a printer according to a second embodiment, in which the sheet cassettes are in the first state.
Figure 14:
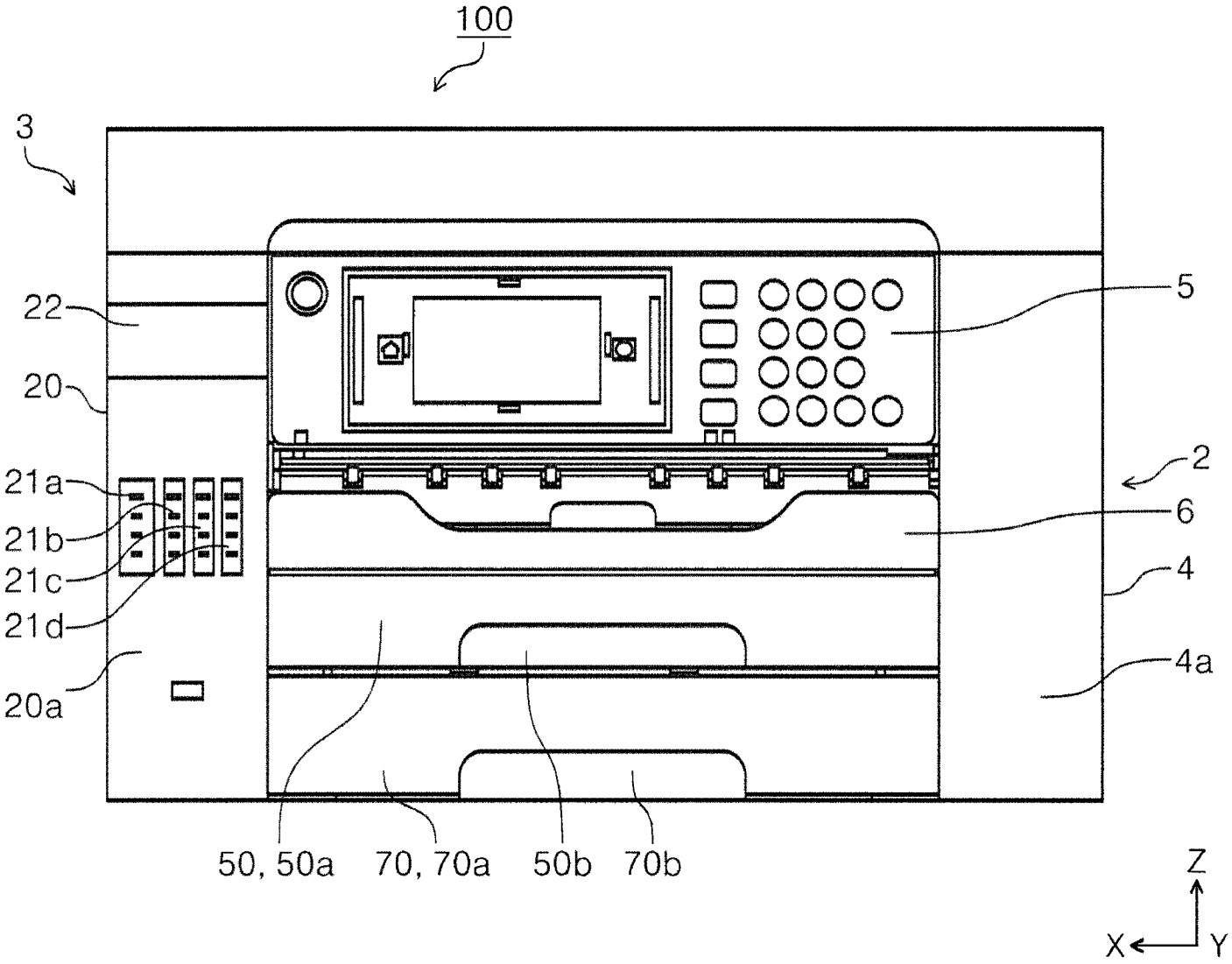
FIG. 14 is a front view illustrating the printer according to the second embodiment, in which the sheet cassettes are in the first state.
Figure 15:
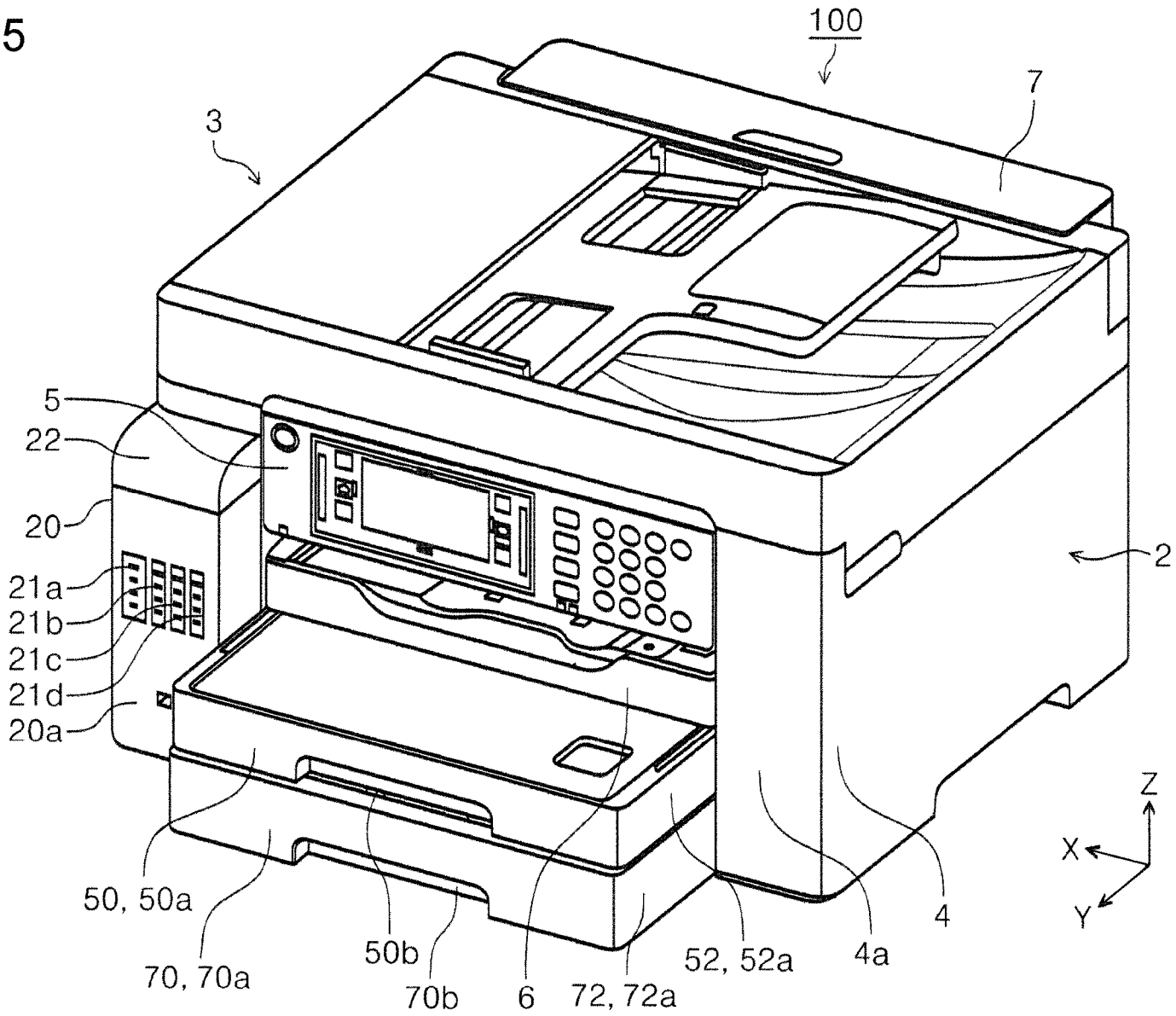
FIG. 15 is a perspective view illustrating the printer according to the second embodiment, in which the sheet cassettes are in the second state.

Next, a printer 100 according to another embodiment will be described with reference to FIGS. 13 to 15. In the printer 100, elements similar to those of the printer 1 described before will be denoted by the same references, and duplicated description will be omitted. The printer 100 according to the present embodiment is different from the above-described printer 1 in that the printer 100 includes an ink container unit 20 on the front side of the apparatus. The ink container unit 20 is disposed on the front side of the apparatus so as to slightly protrude frontward.

The ink container unit 20 is configured to contain a plurality of inks of different colors, for example, black, cyan, magenta, and yellow. In the ink container unit 20, ink level windows 21*a*, 21*b*, 21*c*, and 21*d*, which visually indicate remaining amounts of respective inks, are formed on the front side thereof. An openable/closable cover 22 is disposed in an upper portion of the ink container unit 20 and is configured such that opening the cover 22 allows ink refilling. As illustrated in FIG. 15, in the printer 100 configured as above, the step portions on respective side surfaces of each cassette are not exposed and are positioned inside the insertion/removal mouth when the cassette is in the most stretched state and is installed in the apparatus. This suppresses the likelihood of each sheet cassette orienting obliquely with respect to the sheet transporting direction (Y direction), thereby suppressing the likelihood of a recording sheet to be transported obliquely. This also suppresses the likelihood of dust entering the apparatus through the gaps.

In the embodiments described above, the recording apparatus includes a plurality of medium accommodation cassettes, such as the first sheet cassette 50 and the second sheet cassette 70. However, the recording apparatus may include a single sheet cassette or may include three or more sheet cassettes. However, in spite of the number of sheet cassettes provided therein, each sheet cassette is preferably configured to be stretchable in such a manner that the step portions on respective side surfaces of the sheet cassette are not exposed when the sheet cassette is in the most stretched state and is installed in the apparatus.

What is claimed is:

1. A recording apparatus, comprising:

an apparatus body including a recording unit that performs recording onto a medium; and a medium accommodation cassette that is configured to be inserted into and removed from the apparatus body through an insertion/removal mouth formed in the apparatus body and that has a medium accommodation region formed therein for accommodating the medium, the medium accommodation cassette being configured such that the medium accommodation region is stretchable and contractible in a cassette insertion/removal direction, wherein the medium accommodation cassette includes a first medium accommodation portion that forms a portion of the medium accommodation region, and a second medium accommodation portion that forms a portion of the medium accommodation region and is located further, from the first medium accommodation portion, in a cassette removing direction in which the medium accommodation cassette is being removed from the apparatus body, the second medium accommodation portion being configured to be switchable between a first state and a second state in which the second medium accommodation portion is displaced from a position thereof in the first state in the cassette removing direction so as to stretch the medium accommodation region, wherein in a width direction that orthogonally intersects the cassette insertion/removal direction, a maximum length of the second medium accommodation portion is made greater than a maximum length of the first medium accommodation portion, and a step portion is formed on a side surface of the medium accommodation cassette, the step portion is positioned inside the insertion/removal mouth when the second medium accommodation portion assumes the second state in the state in which the medium accommodation cassette is inserted in the apparatus body, a portion of side surface of the second medium accommodation portion that is located further in the cassette removing direction from the step portion is formed as a flat and smooth surface, the apparatus body includes a posture-maintaining member disposed inside the insertion/removal mouth, the posture-maintaining member maintaining posture of the medium accommodation cassette by regulating a rise of the first medium accommodation portion when the medium accommodation cassette is drawn, the posture-maintaining member is formed of an abutting member that comes into contact with the first medium accommodation portion from above, and the second medium accommodation portion includes a slit configured to receive the abutting member, the slit being formed in an upper side of the second medium accommodation portion.

2. The recording apparatus according to claim 1, wherein a portion of upper edge of the second medium accommodation portion that is located further in the cassette removing direction from the step portion is formed non-stepwise.

3. The recording apparatus according to claim 2, wherein the recording apparatus includes a plurality of the medium accommodation cassettes, and the medium accommodation cassettes are a first medium accommodation cassette and a second medium accommodation cassette that is positioned under the first medium accommodation cassette, in the apparatus body, a region for accommodating the first medium accommodation cassette is formed so as not to be separated from a region for accommodating the second medium accommodation cassette, and a height of a front surface of the second medium accommodation cassette is made greater than a height of a front surface of the first medium accommodation cassette in such a manner that an upper edge of the front surface of the second medium accommodation cassette is positioned adjacent to a lower edge of the front surface of the first medium accommodation cassette.

4. The recording apparatus according to claim 3, wherein the second medium accommodation portion of the first medium accommodation cassette has a cover member that covers the medium accommodation region from above, and when the second medium accommodation portion of the first medium accommodation cassette is switched to the second state, a portion of the medium accommodation region that protrudes outward from a front side of the apparatus is covered with the cover member from above.

* * * * *